US012667165B2

(12) United States Patent
Kim et al.

(10) Patent No.: US 12,667,165 B2
(45) Date of Patent: Jun. 30, 2026

(54) INSOLE FOR GOLF SHOES

(71) Applicant: BULLSONE CO., LTD., Seoul (KR)

(72) Inventors: So Hee Kim, Incheon (KR); Byoung Jun Seo, Incheon (KR); Ju Young Kim, Incheon (KR); Young Jin Kim, Incheon (KR)

( * ) Notice: Subject to any disclaimer, the term of this patent is extended or adjusted under 35 U.S.C. 154(b) by 0 days.

(21) Appl. No.: 18/785,348

(22) Filed: Jul. 26, 2024

(65) Prior Publication Data

US 2025/0248485 A1 Aug. 7, 2025

(30) Foreign Application Priority Data

Feb. 7, 2024 (KR) ..... 10-2024-0018952

(51) Int. Cl.
*A43B 17/02* (2006.01)
*A43B 5/00* (2022.01)

(52) U.S. Cl.
CPC ..... *A43B 17/026* (2013.01); *A43B 5/001* (2013.01)

(58) Field of Classification Search
CPC ..... A43B 17/003; A43B 17/02; A43B 7/1405; A43B 7/141; A43B 7/142; A43B 7/1435; A43B 7/144; A43B 7/145; A43B 7/24
See application file for complete search history.

(56) References Cited

U.S. PATENT DOCUMENTS 4,682,425 A * 7/1987 Simmons ..... A43B 17/02 36/43
4,813,157 A * 3/1989 Boisvert ..... A43B 7/145 36/145
2008/0086909 A1* 4/2008 Raspini ..... A43B 7/145 36/44
2010/0205831 A1* 8/2010 Cheskin ..... A43B 1/0009 36/44
2018/0206595 A1* 7/2018 Lo ..... A43B 13/226
2019/0021438 A1* 1/2019 Salkavich ..... A43B 7/144
2019/0116929 A1* 4/2019 Kurcinka ..... A43B 13/16

(Continued)

FOREIGN PATENT DOCUMENTS

DE 202007013671 U1 * 2/2008 ..... A43B 17/14
JP 3149415 3/2009

(Continued)

OTHER PUBLICATIONS

Spenco. "Spenco Golf Insole Men: Enhanced Stability, Precision Swing, and Comfort Fit for Optimal Performance". Retrieved from internet: <URL: https://www.amazon.com/Spenco-Golf-Insole-Men-Performance/dp/B003EOA8TW/?th=1> (Year: 2014).*

(Continued)

*Primary Examiner* — Aiying Zhao
(74) *Attorney, Agent, or Firm* — IpHorgan Ltd.

(57) ABSTRACT

An insole for golf shoes may be inserted into the inside of a golf shoe to support the sole of a wearer's foot. The insole includes: a main body on which sole of foot is seated; a first cushion portion which is provided on the main body and supports a portion of a front portion of the foot; and a second cushion portion which is provided on the main body, supports the remaining portion of the front portion of the foot, is formed in an area of a part where a little toe is seated, and supports a side of the front portion of the foot.

2 Claims, 10 Drawing Sheets

(56) References Cited

U.S. PATENT DOCUMENTS

| | | | | |
|---|---|---|---|---|
| 2020/0154827 | A1* | 5/2020 | Kfir | A43B 7/1435 |
| 2024/0032644 | A1* | 2/2024 | Choi | A61H 39/04 |

FOREIGN PATENT DOCUMENTS

| | | | | |
|---|---|---|---|---|
| JP | 2018515200 | A | 6/2018 | |
| KR | 200436592 | B1 | 9/2007 | |
| KR | 100802066 | B1 * | 2/2008 | A43B 17/02 |

OTHER PUBLICATIONS

Korean Intellectual Property Office, Office Action for App. No. 10-2024-0018952, Sep. 11, 2025, Korea.

* cited by examiner

MOVEMENT OF TIP OF TOE

INSOLE FOR GOLF SHOES

CROSS REFERENCE TO RELATED APPLICATION

The present application claims priority to Korean Patent Application No. 10-2024-0018952, filed on Feb. 7, 2024, the entire contents of which is incorporated herein for all purposes by this reference.

FIELD

The present disclosure relates to an insole for golf shoes and more particularly to an insole for golf shoes, which is inserted into the inside of a golf shoe and supports the sole of a wearer's foot.

BACKGROUND

In general, an insole is inserted into the inside of the upper portion of a shoe and directly supports the sole of a wearer's foot, thereby providing comfort and absorbing some impact while walking.

Recently, with the increase in the population participating in leisure activities, insoles, such as hiking insoles, etc., developed to suit the characteristics of leisure activities are being proposed.

In particular, golf is a sport that requires a good posture compared to other sports.

FIG. 1 shows plantar pressure distribution that occurs during a golf swing, for each swing posture.

As shown in FIG. 1, during the swing motion, it can be seen that a contact area between the foot and the ground and the strength of force applied to the sole change.

In such a swing posture, during the impact motion, left foot serves as a central axis of the swing. Also, depending on the movements of the feet and upper body, the hitting direction changes and the traveling direction, driving distance, etc., of the ball are determined.

Generally, during the swing motion, both feet tend to turn outward during the weight shifting process. This makes it difficult to maintain a consistent swing path, hinders smooth upper body twisting motion, reduces lower body support power, and increases the width of the left and right movement of the upper body during the swing motion. As a result, the accuracy and force of the hitting are reduced, so that the driving distance is reduced and poor directionality is caused.

PRIOR ART DOCUMENT

Patent Document

Korean Registered Utility Model No. 20-0436592 (Sep. 4, 2007)

SUMMARY

The embodiment of the present disclosure is designed to overcome the above problems and the purpose of the present disclosure is to provide an insole for golf shoes, which maintains stably a swing posture.

One embodiment is an insole for golf shoes, which includes: a main body on which sole of foot is seated; a first cushion portion which is provided on the main body and supports a portion of a front portion of the foot; and a second cushion portion which is provided on the main body, supports the remaining portion of the front portion of the foot, is formed in an area of a part where a little toe is seated, and supports a side of the front portion of the foot.

In the second cushion portion, a width L2 parallel to a width direction of the sole may be formed to have a length of 10 to 40% of a width L1 of the main body on the same line RL.

The second cushion portion may be formed to protrude in such a manner as to have a thickness of 1 to 5 mm larger than the first cushion portion.

Also, in the main body, a region where the second cushion portion is provided may be formed to be recessed further inward than a region where the first cushion portion is provided.

Also, the first cushion portion may be formed in a honeycomb structure where a plurality of first hexagonal columns shares a first partition wall. The second cushion portion may be formed in a honeycomb structure where a plurality of second hexagonal columns shares a second partition wall.

Here, the second partition wall may be formed thicker than the first partition wall.

The second cushion portion may be formed of a gel material including one or more of thermo plastic elastomer (TPE), urethane, and ethylene-vinyl acetate copolymer (EVA).

The first cushion portion may be formed of a gel material including one or more of styrene ethylene butylene styrene (SEBS) having viscoelasticity, urethane, and silicone.

Also, the second cushion portion may be formed, of which the area is reduced from the front to the rear, based on the length direction of the sole.

Furthermore, the second cushion portion may be formed of a material having a higher rigidity than the first cushion portion.

The main body may include: a surface layer, an intermediate layer, and a bottom layer. The sole is seated on the surface layer. The intermediate layer is formed on the surface layer and provides a cushioning force. The bottom layer is formed on the intermediate layer and includes the first cushion portion and the second cushion portion.

Also, the insole may further include a third cushion portion which is provided on the main body and supports a rear portion of the foot.

Here, the main body may further include an arch support that protrudes to support arch of the foot between the first cushion portion and the third cushion portion.

According to the insole for golf shoes of the present disclosure, it is possible to improve posture stability and balance by distributing body pressure during the swing motion.

Also, according to the insole for golf shoes, the central axis of the swing can be fixed by fixing the center of body pressure, thereby improving sway and increasing the accuracy of hitting.

Furthermore, according to the insole for golf shoes, the swing posture can be corrected, so that it is possible to improve the carry and driving distance and to reduce the direction angle.

DETAILED DESCRIPTION

Figure 1:
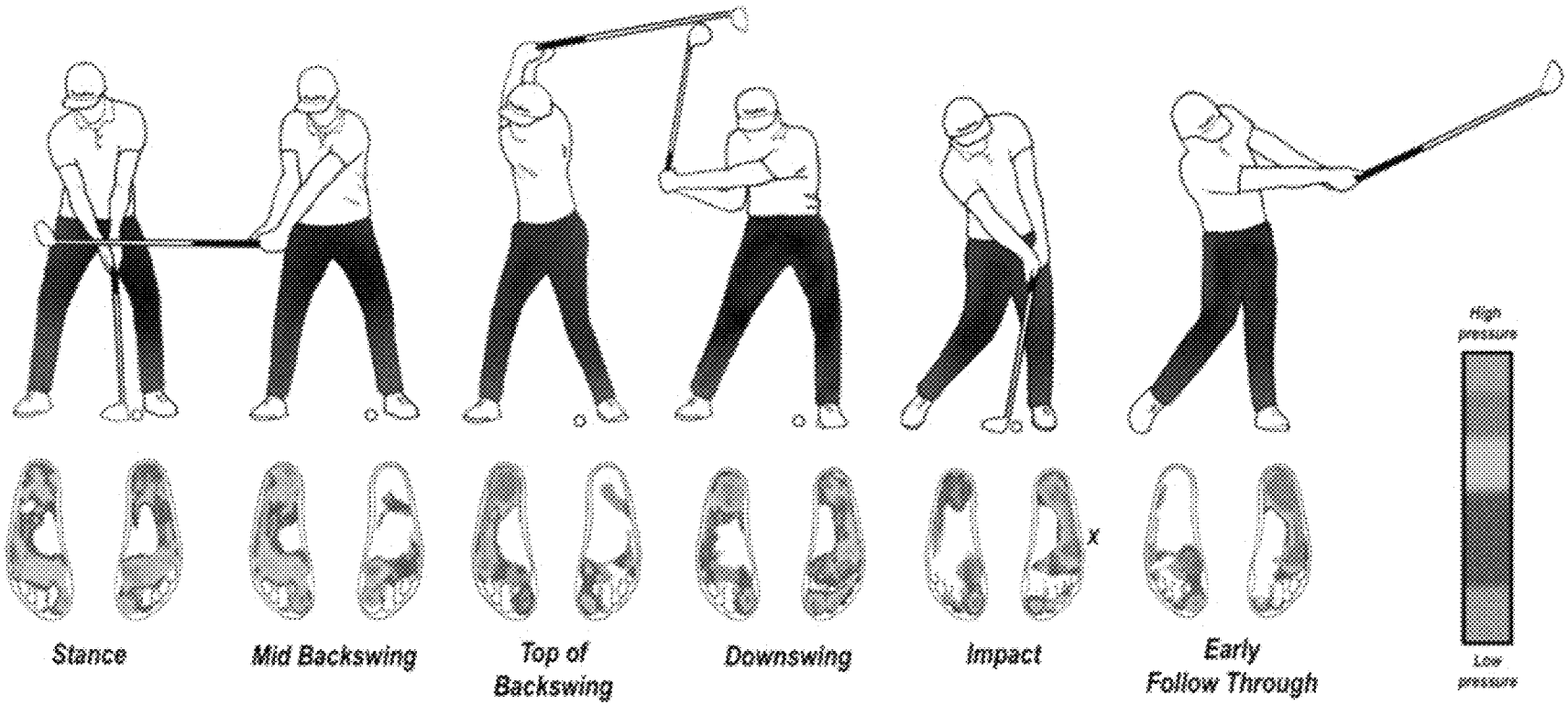
FIG. 1 shows plantar pressure distribution that occurs during a golf swing, for each swing posture.

Hereinafter, preferred embodiments of the present invention will be described in detail with reference to the accompanying drawings.

As the present invention can have various embodiments as well as can be diversely changed, specific embodiments will be illustrated in the drawings and described in detail. While the present invention is not limited to particular embodiments, all modification, equivalents and substitutes included in the spirit and scope of the present invention are understood to be included therein.

Terms used in the present specification are provided for description of only specific embodiments of the present invention, and not intended to be limiting. An expression of a singular form includes the expression of plural form thereof unless otherwise explicitly mentioned in the context.

Unless otherwise defined, all terms used herein including technical and scientific terms have the same meaning as commonly understood by one of ordinary skill in the art to which the present invention belongs. Terms, for example, commonly used terms defined in the dictionary, are to be construed to have exactly the same meaning as that of related technology in the context. As long as terms are not clearly defined in the present application, the terms should not be ideally or excessively construed as formal meaning.

Hereinafter, specific embodiments of the present invention will be described with reference to the accompanying drawings.

Figure 2:
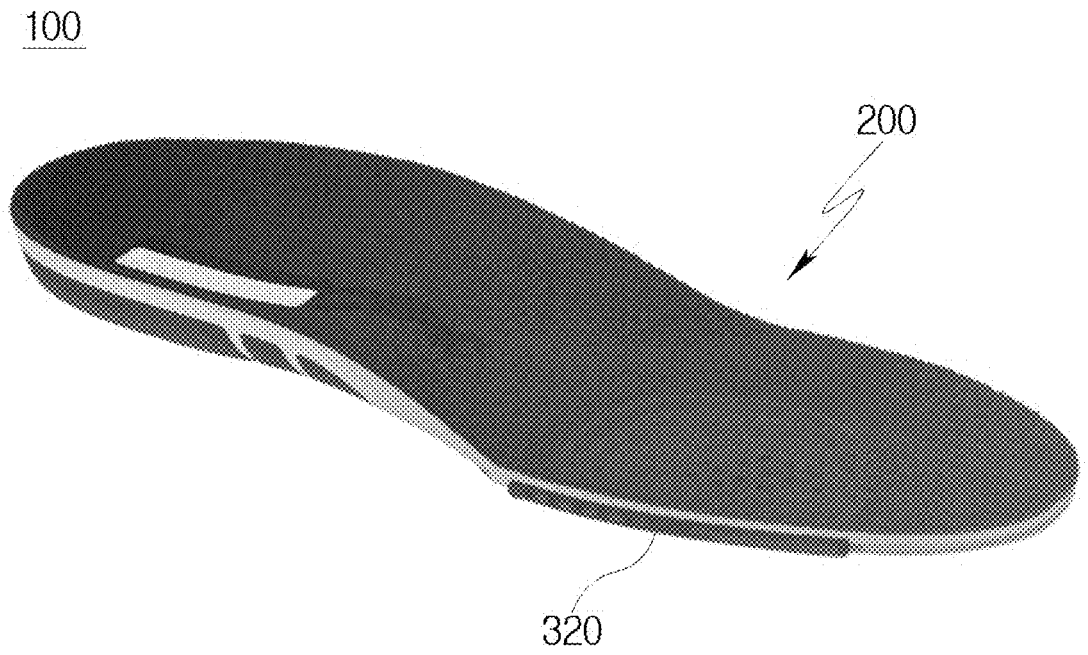
FIG. 2 is a perspective view schematically showing an insole for golf shoes according to an embodiment of the present disclosure.
Figure 3:
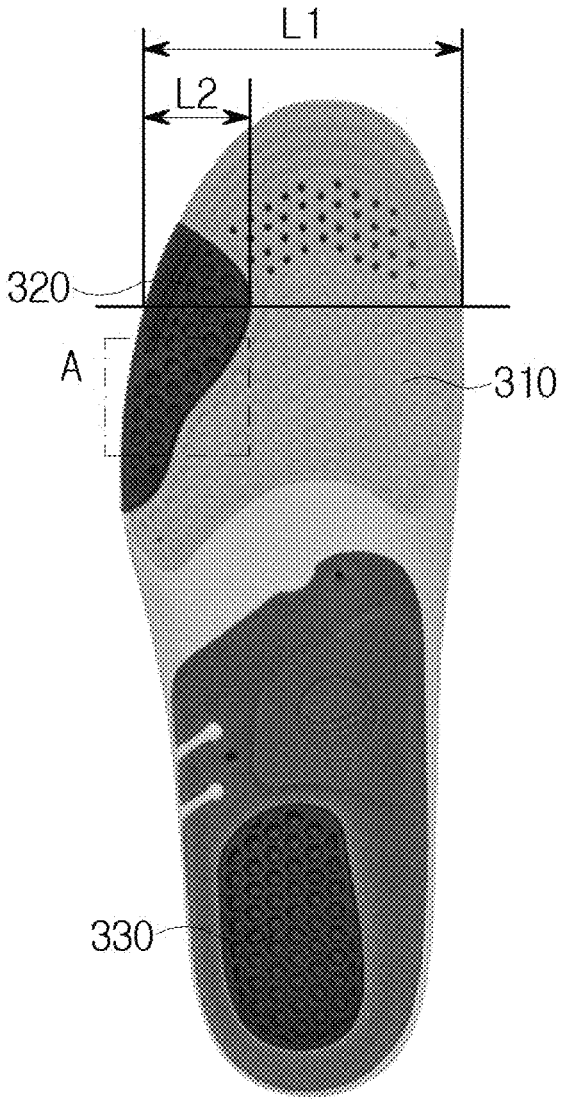
FIG. 3 is a plan view schematically showing the insole for golf shoes according to the embodiment of the present disclosure.
Figure 4:
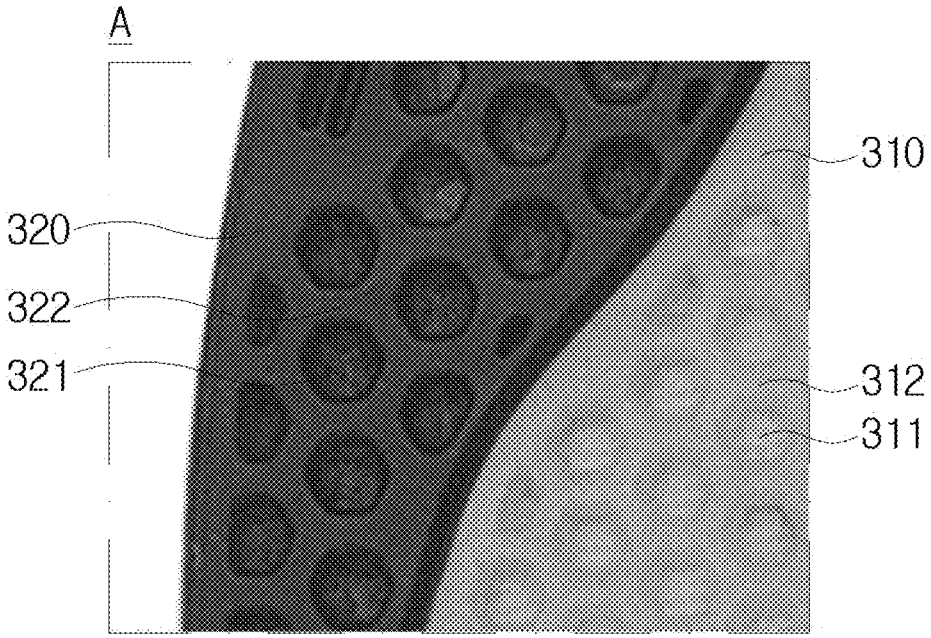
FIG. 4 is a perspective view showing schematically a region "A" of FIG. 3.
Figure 5:
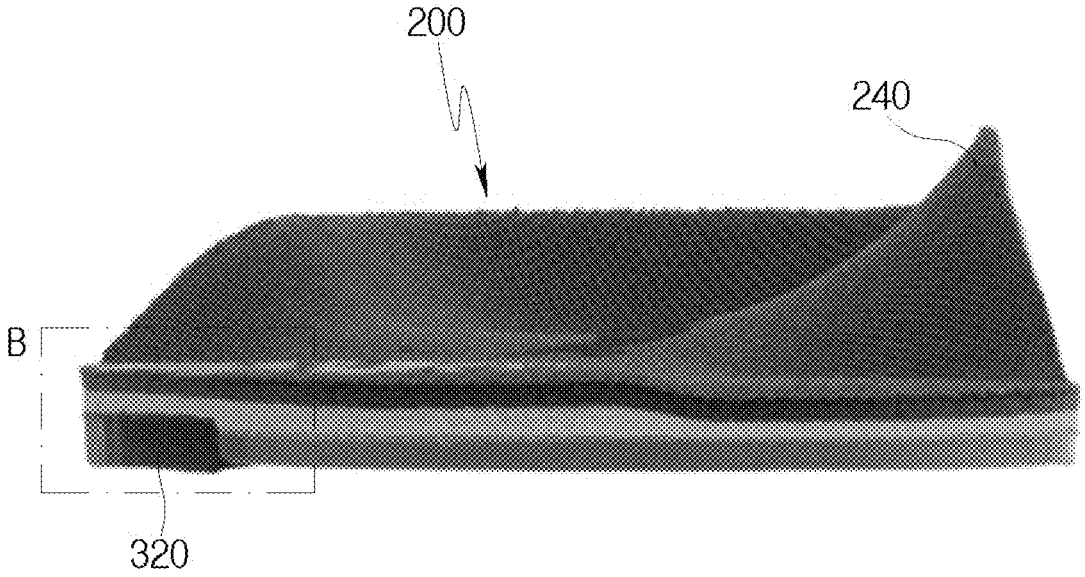
FIG. 5 is a front view schematically showing the insole for golf shoes according to the embodiment of the present disclosure.
Figure 6:
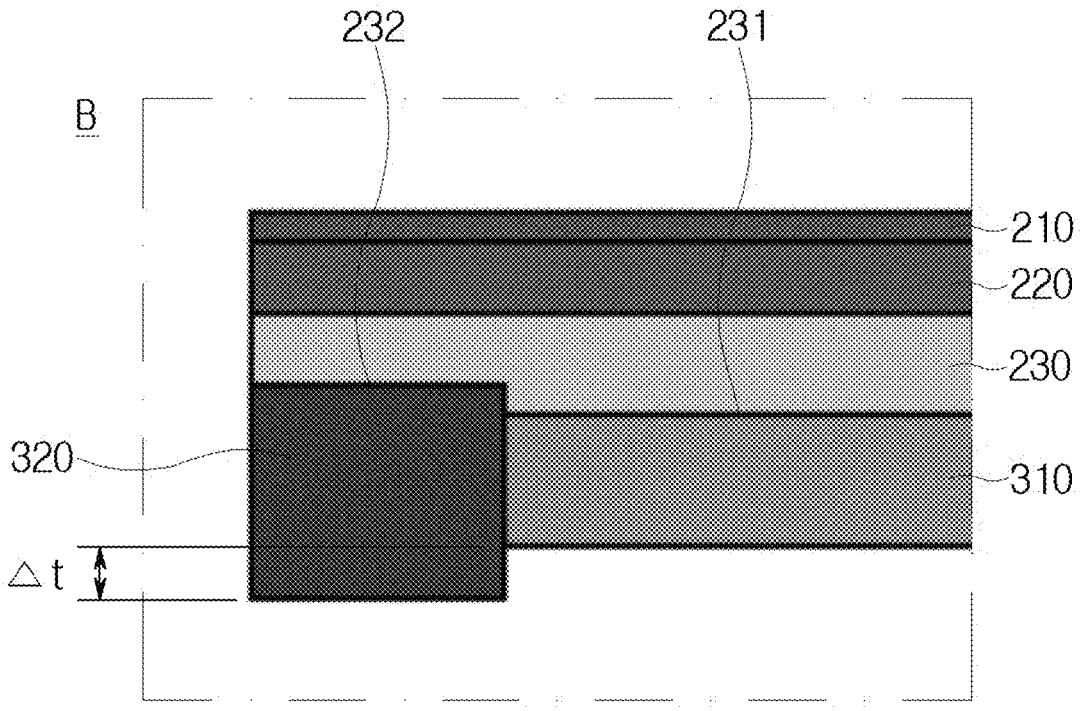
FIG. 6 is a perspective view showing schematically a region "B" of FIG. 5.

FIGS. 2 and 3 are a perspective view and a plan view which schematically show an insole for golf shoes according to the embodiment of the present disclosure. FIG. 4 is a perspective view showing schematically a region "A" of FIG. 3. FIG. 5 is a front view schematically showing the insole for golf shoes according to the embodiment of the present disclosure. FIG. 6 is a perspective view showing schematically a region "B" of FIG. 5.

Figure 7:
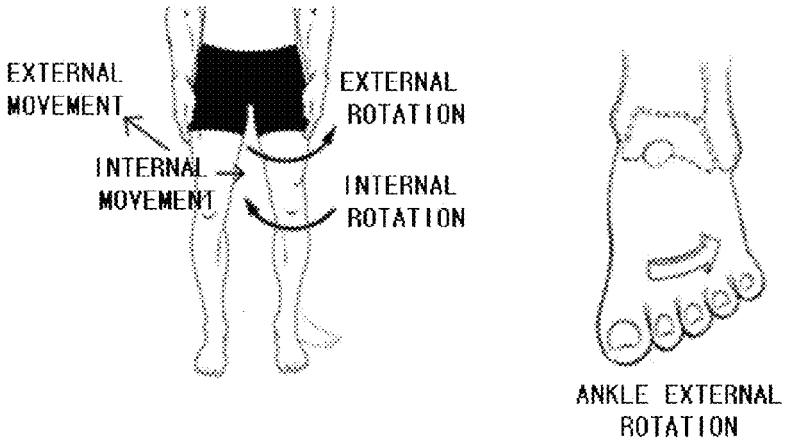
FIG. 7 is a graph showing the comparison of body twisting when an impact occurs in a state of wearing a conventional insole for golf shoes and the insole for golf shoes according to the embodiment of the present disclosure.
Figure 7:
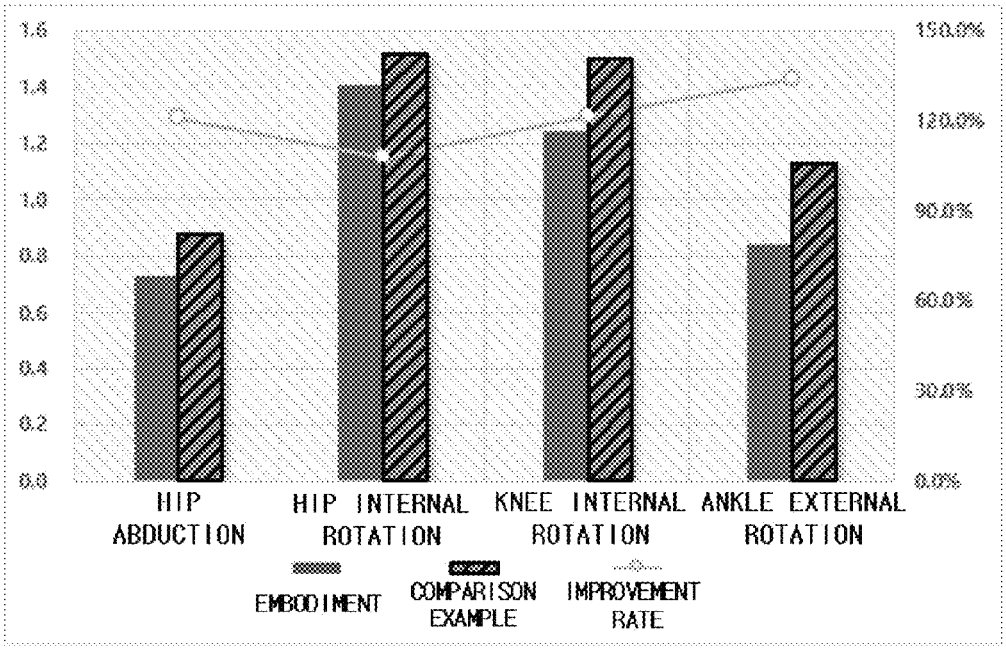
Figure 8:
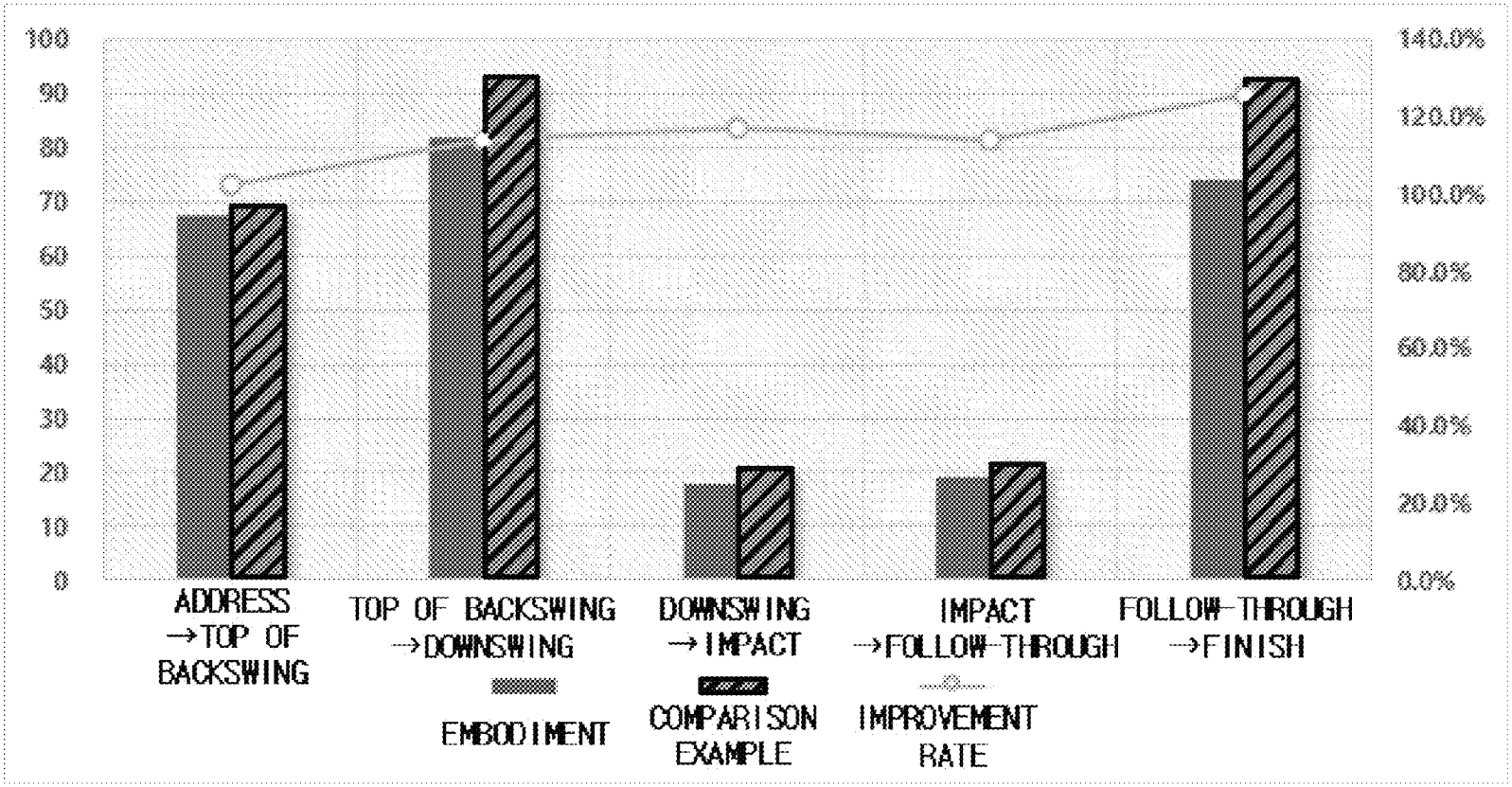
FIG. 8 is a graph showing the comparison of upper body shaking when swinging in the state of wearing a conventional insole for golf shoes and the insole for golf shoes according to the embodiment of the present disclosure.
Figure 9:
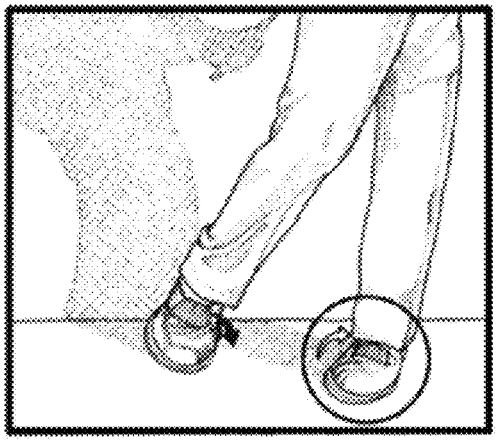
FIG. 9 is a graph showing the comparison of the movements of tip of toe after the impact in the state of wearing a conventional insole for golf shoes and the insole for golf shoes according to the embodiment of the present disclosure.
Figure 9:
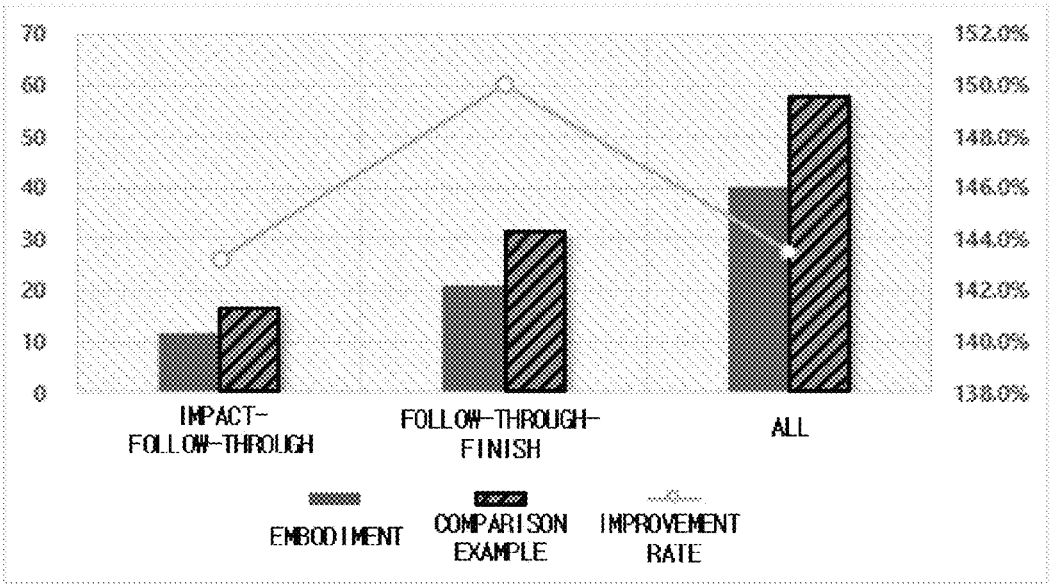
Figure 10:
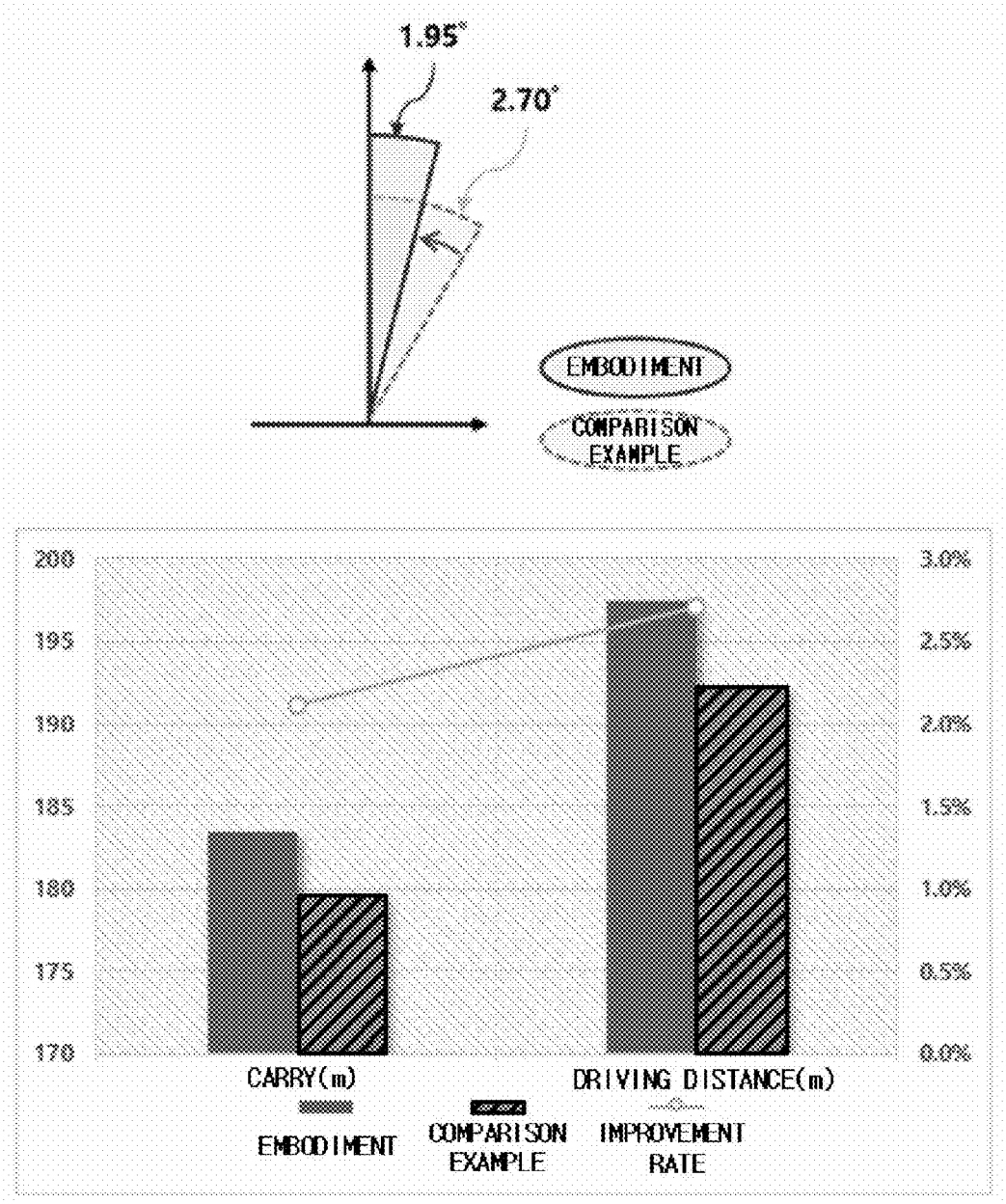
FIG. 10 is a graph showing the comparison of the carry, driving distance, and direction angle of a golf ball after the impact in the state of wearing a conventional insole for golf shoes and the insole for golf shoes according to the embodiment of the present disclosure.

FIG. 7 is a graph showing the comparison of body twisting when an impact occurs in a state of wearing a conventional insole for golf shoes and the insole for golf shoes according to the embodiment of the present disclosure. FIG. 8 is a graph showing the comparison of upper body shaking when swinging. FIG. 9 is a graph showing the comparison of the movements of tip of toe after the impact. FIG. 10 is a graph showing the comparison of the carry, driving distance, and direction angle of a golf ball after the impact.

Referring to FIGS. 2 to 10, the insole 100 for golf shoes according to an embodiment of the present invention includes a main body 200 on which the sole of foot is seated, a first cushion portion 310 which is provided on the main body 200 and supports a portion of a front portion of the foot, and a second cushion portion 320 which is provided on the main body, supports the remaining portion of the front portion of the foot, is formed in an area of a part where a little toe is seated, and supports the side of the front portion of the foot.

In other words, the first cushion portion 310 and the second cushion portion 320 are provided together on the front bottom surface of the main body 200 to support the front portion of a wearer's foot, and the second cushion portion 320 supports the side of the front portion of the foot where a little toe is seated.

Through this, during the swing motion, the outside of the foot, that is, the side of the foot, which serves as a central axis of the swing during the weight shifting process, is supported by the second cushion portion 320, thereby causing the force to be distributed to the inside of the sole of the foot and preventing the foot from being turned outward.

More specifically, referring to FIG. 3, in the second cushion portion 320, a width L2 parallel to the width direction of the sole may be formed to have a length of 10 to 40% of a width L1 of the main body 200 on the same line RL. Here, the second cushion portion 320 may be formed, of which the area is reduced from the front to the rear, based on the length direction of the sole. In other words, the second cushion portion 320 is formed in an area that supports the side of the foot where the force is focused during the swing.

Also, referring to FIG. 6, the second cushion portion 320 may be formed to protrude in such a manner as to have a thickness of 1 to 5 mm larger than the first cushion portion 310. In other words, a difference $\Delta t$ between the surface of the second cushion portion 320 and the surface of the first cushion portion 310 may be 1 to 5 mm.

Therefore, the second cushion portion 320 may be formed 1 to 5 mm thicker than the first cushion portion 310.

For example, referring to FIG. 6, in the main body 200, a region 232 where the second cushion portion 320 is provided may be formed to be recessed further inward than a region 231 where the first cushion portion 310 is provided.

Through this, the thickness $\Delta t$ of the second cushion portion 320, which protrudes more than the first cushion portion 310, can be maintained to be 1 to 5 mm while the second cushion portion 320 is formed to have a larger thickness. Accordingly, it is possible to further improve the support rigidity.

With this configuration, during the swing, since the load is concentrated on the second cushion portion 320 and a greater force is applied to the second cushion portion 320 rather than the first cushion portion 310, the second cushion portion 320 is formed thicker to more stably support.

Furthermore, the second cushion portion 320 may be formed of a material having a higher rigidity than the first cushion portion 310.

For example, the second cushion portion 320 may be formed of a gel material including one or more of thermo plastic elastomer (TPE), urethane, and ethylene-vinyl acetate copolymer (EVA).

Here, the first cushion portion 310 may be formed of a gel material including one or more of styrene ethylene butylene styrene (SEBS) having viscoelasticity, urethane, and silicone.

Further, the second cushion portion 320 and the first cushion portion 310 may be formed of the same material.

A foam material used in a conventional insole has a problem of being permanently deformed and losing elasticity when it is used for a long period of time. Also, impact absorption and durability of the foam material-made insole may be degraded when it is used for a long period of time.

In the embodiment of the present disclosure, the first cushion portion 310 and the second cushion portion 320 are formed of a gel material having viscoelasticity, so that they are less deformed than when they are formed of a conventional material and are able to maintain the impact absorption and durability, even they are used for a long period of time. Through this, excellent wearing comfort can be provided to a user and fatigue of the foot can be reduced even when the user walks for a long time.

Also, referring to FIG. 4, a honeycomb structure where the first cushion portion 310 and a plurality of first hexagonal columns 311 share a first partition wall 312 may be provided. Also, a honeycomb structure where the second cushion portion 320 and a plurality of second hexagonal columns 321 share a second partition wall 322 may also be provided.

Here, in order to further increase the rigidity of the second cushion portion 320 against the compressive force than that of the first cushion portion 310, the thickness of the second partition wall 322 may be larger than the thickness of the first partition wall 312.

Here, when viewed in a cross-section parallel to the ground, the honeycomb structure shows that hexagons and hexagons are arranged adjacent to each other. Through such a honeycomb structure, the load is optimally distributed to provide a comfortable wearing sensation even when the user walks for a long time. Also, the cross-sectional shape of the honeycomb structure is not limited to a hexagon, and the honeycomb structure may have a cross-sectional shape in which hexagons and polygons other than the hexagon are arranged adjacent to each other.

Further, referring to FIG. 6, the main body 200 may include a surface layer 210, an intermediate layer 220, and a bottom layer 230. The sole is seated on the surface layer 210. The intermediate layer 220 is formed on the surface layer 210 and provides a cushioning force. The bottom layer 230 is formed on the intermediate layer 220 and includes the first cushion portion 310 and the second cushion portion 320.

Here, the intermediate layer 220 may be made of Ortholite, and the bottom layer 230 may be made of ethylene-vinyl acetate copolymer (EVA). Also, the materials forming the intermediate layer 220 and the bottom layer 230 are not limited thereto, and various known materials can be used.

Also, the bottom layer 230 may be formed to have a level difference such that the region 232 where the second cushion portion 320 is formed to be recessed further inward than the region 231 where the first cushion portion 310 is provided.

Furthermore, referring to FIG. 3, the insole may further include a third cushion portion 330 which is provided on the main body 200 and supports a rear portion of the foot.

In other words, the third cushion portion 330 is formed to support the heel, that is, the rear portion of the foot. The third cushion portion 330 may be made of the same material and in the same shape as those of the first cushion portion 310 or the second cushion portion 320.

Also, the main body 200 may further include an arch support 240 that protrudes to support the arch of the foot between the first cushion portion 310 and the third cushion portion 330.

The arch support 240 may be formed the highest on the main body 200 in such a way as to effectively contact the sole according to the shape of the foot. In other words, the arch support 240 is in close contact with the arch recessed inward on the sole of the foot, thereby stably supporting the entire sole. Also, the arch support 240 may provide appropriate stimulation to the arch of the foot during walking, enhance the user's sense of balance, strengthen the foot muscles, and induce correct walking.

As such, the insole 100 for golf shoes according to the embodiment of the present disclosure includes the second cushion portion 320 to support the side of the front portion of the foot where a little toe is seated. The second cushion portion 320 supports to prevent the foot from being turned outward during the swing, so that the central axis can be fixed. Therefore, posture stability and balance are improved and the accuracy of hitting is enhanced. As a result, it is possible to improve the carry and driving distance and to reduce the direction angle.

Hereinafter, with reference to the attached drawings, the effect during the swing according to wearing the insole 100 for golf shoes according to the embodiment of the present disclosure will be described in more detail.

Data described below represent average values measured in a state where 10 professional golfers and 10 amateur golfers wear the insole 100 for golf shoes and conventional insoles, respectively. In the data, an improvement rate (%) indicates that 100% is the same value as the conventional insole, and values exceeding 100% correspond to improved values.

The following Table 1 and FIG. 7 show the comparison of body twisting when an impact occurs in a state of wearing the conventional insole for golf shoes and the insole for golf shoes according to the embodiment of the present disclosure.

Here, the body twisting when an impact occurs is shown as the angles of hip abduction, hip internal rotation, knee internal rotation, and ankle external rotation obtained through multiple measures and the deviations of them.

As shown in Table 1 and FIG. 7, it can be seen that the angle deviation is reduced at each position when the user wears the insole 100 for golf shoes according to the embodiment of the present disclosure. In other words, it can be seen that the posture is not lost when an impact occurs and the user is able to perform the impact in a uniform posture.

TABLE 1

| Category | Hip abduction | Hip internal rotation | Knee internal rotation | Ankle external rotation |
|---|---|---|---|---|
| Embodiment | 0.73 | 1.41 | 1.24 | 0.84 |
| Comparison example | 0.88 | 1.52 | 1.50 | 1.13 |
| Difference | 0.15 | 0.11 | 0.26 | 0.29 |
| Improvement rate [%] | 120.8 | 107.8 | 121.2 | 133.8 |

The following Table 1 and FIG. 8 show the comparison of upper body shaking when swinging in the state of wearing the conventional insole for golf shoes and the insole for golf shoes according to the embodiment of the present disclosure.

Here, the upper body shaking when swinging corresponds to a value representing a travel distance (mm) from the center of the shoulder. The greater the travel distance, the more the central axis collapses. Therefore, it is advantageous to reduce the travel distance.

Also, the upper body shaking when swinging was measured at each of five stages: from address to top of backswing, from top of backswing to downswing, from downswing to impact, from impact to follow-through, and from follow-through to finish.

As shown in Table 2 and FIG. 8, it can be seen that the travel distance from the center of the shoulder is reduced at each stage when the user wears the insole 100 for golf shoes according to the embodiment of the present disclosure. In other words, it can be seen that the center is not lost when swinging and the swing can be performed in a stable posture.

TABLE 2

| Category | Address → top of backswing | top of backswing → downswing | downswing → impact | impact → follow-through | follow-through → finish |
|---|---|---|---|---|---|
| Embodiment | 67.66 | 81.78 | 17.87 | 18.94 | 74.02 |
| Comparison example | 69.20 | 93.13 | 20.92 | 21.64 | 92.78 |
| Difference | 1.53 | 11.34 | 3.04 | 2.69 | 18.77 |
| Improvement rate [%] | 102.3 | 113.9 | 117.0 | 114.2 | 125.4 |

The following Table 3 and FIG. 9 show the comparison of the movements of tip of toe after the impact in the state of wearing a conventional insole for golf shoes and the insole for golf shoes according to the embodiment of the present disclosure.

Here, the movements of tip of toe when the impact occurs and after the impact correspond to values obtained by measuring the left-right shaking of tip of toe on the central axis.

As shown in Table 3 and FIG. 9, it can be seen that the movements of tip of toe are reduced when the user wears the insole 100 for golf shoes according to the embodiment of the present disclosure.

Generally, after the impact, the posture is lost, the movement of the foot serving as a central axis increases, and sway phenomenon (when the left foot serves as a central axis, the center shifts to the right) occurs.

TABLE 3

| Category | Impact - Follow-through | Follow through - finish | All |
|---|---|---|---|
| Embodiment | 11.71 | 21.05 | 40.09 |
| Comparison example | 16.77 | 31.57 | 57.55 |
| Difference | 5.06 | 10.52 | 17.46 |
| Improvement rate [%] | 143.2 | 150.0 | 143.5 |

The following Table 4 and FIG. 10 show the comparison of the carry, driving distance, and direction angle of a golf ball after the impact in the state of wearing a conventional insole for golf shoes and the insole for golf shoes according to the embodiment of the present disclosure.

Here, the carry, driving distance, and direction angle were measured by a screen golf simulator, and the direction angle represents an angle at which it is deviated from a set center.

As shown in Table 4 and FIG. 10, it can be seen that, when the user wears the insole 100 for golf shoes according to the embodiment of the present disclosure, the carry and driving distance are increased and the direction angle is reduced, so that hitting is possible in a more accurate direction.

TABLE 4

| Category | Carry (m) | Driving distance (m) | Direction angle (°) |
|---|---|---|---|
| Embodiment | 183.40 | 197.45 | 1.94 |
| Comparison example | 179.60 | 192.25 | 2.70 |
| Difference | 3.80 | 5.20 | −0.75 |
| Improvement rate [%] | 2.12 | 2.70 | 27.78 |

As described above, in the case where the user wears the insole 100 for golf shoes according to the embodiment of the present disclosure, a more stable posture can be maintained by minimizing the body twisting when an impact occurs, the upper body shaking when swinging, and the movement of tip of toe after the impact. Through this, the carry and driving distance of a golf ball after the impact are improved and the direction angle is reduced, so that the user is able to hit the golf ball to a more accurate position.

Although the present invention has been described above by way of the specific embodiments, this is for describing the present invention in detail. The present invention is not limited thereto and it is clear that the present invention can be modified or improved within the spirit of the present invention by those of ordinary skill in the art.

All simple modifications or changes of the present invention fall within the scope of the present invention. The specific scope of protection of the present invention will be apparent by the appended claims.

REFERENCE NUMERALS

| | |
|---|---|
| 100: Insole For Golf Shoes | 200: Main Body |
| 210: Surface Layer | 220: Intermediate Layer |
| 230: Bottom Layer | 240: Arch Support |
| 310: First Cushion Portion | 320: Second Cushion Portion |
| 330: Third Cushion Portion | |

What is claimed is:

1. An insole for golf shoes, the insole comprising:

a main body configured to support a sole of a foot comprising a forefoot;

a first cushion portion which is provided on the main body and configured to support a portion of the forefoot;

a second cushion portion which is provided on the main body, configured to support the remaining portion of the forefoot, is disposed in a region corresponding to a location where a little toe is seated, and is configured to support a lateral side of the forefoot;

a third cushion portion which is provided on the main body and configured to support a rear portion of the foot;

wherein the main body comprises:

a surface layer configured to support the sole of the foot;

an intermediate layer disposed under the surface layer;

a bottom layer disposed under the intermediate layer and including the first cushion portion and the second cushion portion; and an arch support that protrudes between the first cushion portion and the third cushion portion; and wherein the bottom layer includes a first region in which the first cushion portion is provided and a second region in which the second cushion portion is provided, wherein, when the main body is oriented parallel to the ground, the second region is recessed further upward than the first region, and wherein the second cushion portion is configured such that, when the main body is oriented parallel to the ground, at least a portion of the second cushion portion is positioned lower than a lower surface of the first cushion portion, wherein the first cushion portion is formed in a honeycomb structure where a plurality of first hexagonal columns shares a first partition wall, wherein the second cushion portion is formed in a honeycomb structure where a plurality of second hexagonal columns shares a second partition wall, and wherein the second partition wall is formed thicker than the first partition wall.

2. The insole for golf shoes of claim 1, wherein the second cushion portion is formed of a gel material including at least one of a urethane and a thermoplastic elastomer (TPE), the thermoplastic elastomer (TPE) including ethylene-vinyl acetate copolymer (EVA).

* * * * *